US009420903B2

(12) United States Patent
Litalien

(10) Patent No.: US 9,420,903 B2
(45) Date of Patent: Aug. 23, 2016

(54) COMMEMORATIVE PLAQUE FRAME

(71) Applicant: Carrier Mausoleums Construction Inc., Saint-Laurent, Quebec (CA)

(72) Inventor: Sebastien Litalien, Blainville (CA)

(73) Assignee: Carrier Mausoleums Construction Inc., St-Laurent, Quebec (CA)

( * ) Notice: Subject to any disclaimer, the term of this patent is extended or adjusted under 35 U.S.C. 154(b) by 45 days.

(21) Appl. No.: 14/247,800

(22) Filed: Apr. 8, 2014

(65) Prior Publication Data

US 2014/0298700 A1 Oct. 9, 2014

Related U.S. Application Data

(60) Provisional application No. 61/809,504, filed on Apr. 8, 2013.

(51) Int. Cl.
*A47G 1/06* (2006.01)
*E04H 13/00* (2006.01)

(52) U.S. Cl.
CPC ..... *A47G 1/06* (2013.01); *E04H 13/001* (2013.01); *E04H 13/006* (2013.01)

(58) Field of Classification Search
USPC ..... 40/611.03, 606.01, 124.5
See application file for complete search history.

(56) References Cited

U.S. PATENT DOCUMENTS

| | | | | | |
|---|---|---|---|---|---|
| 1,759,544 | A | | 5/1930 | Croes | |
| 1,804,871 | A | * | 5/1931 | Helland | 40/661.06 |
| 2,070,940 | A | * | 2/1937 | Duchan | 248/27.8 |
| 2,610,857 | A | * | 9/1952 | Cook | 369/78 |
| 2,692,055 | A | * | 10/1954 | Feiertag | 108/50.11 |
| 3,709,456 | A | | 1/1973 | Pietsch | |
| 3,952,436 | A | | 4/1976 | Kuhnke | |
| 4,304,447 | A | * | 12/1981 | Ellwood | A45C 11/16 312/204 |
| 4,337,590 | A | * | 7/1982 | Jackson | 40/615 |
| 4,609,234 | A | * | 9/1986 | Naniwa et al. | 312/296 |
| 4,756,108 | A | * | 7/1988 | Lackey et al. | 40/611.03 |
| 4,790,088 | A | | 12/1988 | Morvant | |
| 5,368,378 | A | * | 11/1994 | Curtis | A47B 81/00 312/204 |
| 5,671,097 | A | | 9/1997 | Merriweather, Jr. | |
| 6,199,327 | B1 | | 3/2001 | Krawczyk | |
| 6,351,373 | B1 | * | 2/2002 | Le | H01R 13/629 16/325 |

(Continued)

FOREIGN PATENT DOCUMENTS

| | | | |
|---|---|---|---|
| CA | 2293105 | A1 | 7/2000 |
| CA | 2638634 | A1 | 12/2000 |

*Primary Examiner* — Charles A Fox
*Assistant Examiner* — Christopher e Veraa
(74) *Attorney, Agent, or Firm* — Fraser Clemens Martin & Miller LLC; James D. Miller

(57) ABSTRACT

The commemorative plaque frame supports and displays a commemorative plaque on a funerary crypt or niche shutter. The commemorative plaque frame comprises a frame support for attachment to the shutter and a cover pivotally attached to the frame support in non-removable fashion so as to be pivotable between an opened position in which the cover is pivoted away from the shutter; and a closed position in which the cover is pivoted against the shutter. A plaque enclosure is defined on an inner side of the cover when the cover is in the closed position, the plaque enclosure sized for housing the commemorative plaque therein such that the commemorative plaque is at least partly visible through a window provided on the cover. A plaque support member is carried by one of the cover and the frame support, for supporting the commemorative plaque in the plaque enclosure.

14 Claims, 8 Drawing Sheets

(56) References Cited

U.S. PATENT DOCUMENTS 6,622,345 B2 * 9/2003 Liu ..... E05D 3/022 16/239
6,817,125 B2 * 11/2004 Chatterjea ..... 40/611.02
7,934,782 B2 * 5/2011 Christie ..... E05D 3/022 16/361
7,983,026 B2 * 7/2011 West et al. ..... 361/679.01
8,232,510 B2 * 7/2012 Addesso et al. ..... 219/524
8,336,235 B2 * 12/2012 Biondan ..... 40/124.5
2002/0046684 A1 * 4/2002 Lin ..... A47B 3/0815 108/133
2004/0093692 A1 * 5/2004 Cude ..... E05D 15/56 16/350
2004/0163294 A1 * 8/2004 Hsu ..... 40/611.03
2005/0210720 A1 * 9/2005 Burr et al. ..... 40/209
2008/0237252 A1 * 10/2008 Elefante ..... 220/811
2009/0320337 A1 12/2009 Biondan
2011/0192063 A1 8/2011 Biondan

* cited by examiner

COMMEMORATIVE PLAQUE FRAME

CROSS-REFERENCE DATA

The present application claims the priority of U.S. provisional patent application No. 61/809,504 filed on Apr. 8, 2013.

FIELD OF THE INVENTION

The present invention relates to funeral crypt and niche equipment, and more particularly to a commemorative plaque frame for supporting and displaying a commemorative plaque on a funerary crypt or niche panel called a shutter.

BACKGROUND OF THE INVENTION

It is customary to install commemorative plaques in funerary crypts or niches where information about the deceased will be engraved or otherwise displayed. This information typically includes the name, the date of birth, the date of death and the like. Commemorative plaques are usually made of stone or marble.

The plaques are fixed to the front face of a funerary crypt or niche shutter that closes off an enclosure within which the coffin or urn of the deceased will be stored. To fix the commemorative plaque to the crypt or niche shutter, commemorative plaque frames are used. The plaque frames are often made of bronze. One way to install the plaque and the frame on the crypt or niche shutter, consist in first manually holding the plaque against the crypt or niche shutter and then applying the frame over the plaque and fixing it to the shutter, with suitable fasteners. Alternately, some plaque frames allow the plaque to first be installed on the plaque frame itself, and the combined frame and plaque can then be attached to the crypt or niche shutter as a unit, for example by bolting the frame to the crypt or niche shutter. In both cases, manipulating (a) the plaque and (b) the frame, during installation, is cumbersome. This is true whether the plaque and frame are handled separately or as a unit.

Blank commemorative plaques are often pre-installed in funerary crypts or niches. When a user wishes to buy a funerary crypt or niche for himself (in advance) or for a deceased family member, the commemorative plaque will be removed from the frame and will be engraved with the desired markings. This increases the number of required handlings of the plaque and the frame, and consequently increases the possibility of accidentally breaking the plaque if it is dropped.

SUMMARY OF THE INVENTION

The invention relates to a commemorative plaque frame for supporting and displaying a commemorative plaque on a funerary crypt or niche shutter, comprising:

a frame support for attachment to the shutter;

a cover comprising a window, said cover being pivotally attached to said frame support in non-removable fashion so as to be pivotable between an opened position in which said cover is pivoted away from the shutter; and a closed position in which said cover is pivoted against the shutter; said cover defining opposite outer and inner sides, with said inner side for facing the shutter when said cover is in said closed position and said outer side for facing away from the shutter when said cover is in said closed position;

a plaque enclosure defined on said inner side of said cover when said cover is in said closed position, said plaque enclosure sized for housing the commemorative plaque therein such that the commemorative plaque is at least partly visible through said window; and a plaque support member carried by one of said cover and said frame support, for supporting the commemorative plaque in said plaque enclosure.

In one embodiment, the commemorative plaque further comprises a blocking member capable of maintaining said cover in said opened position.

In one embodiment, the said blocking member comprises a stop provided on said frame support on which said cover abuts.

In one embodiment, when said cover is in said closed position, it defines a top and a bottom, said cover being pivotally attached to said plaque support member with a hinge member that is attached to said plaque support member and to said bottom of said cover.

In one embodiment, in said closed position, said cover is vertical and in said opened position, said cover is maintained in a transversal position with respect to the vertical opened position by means of said blocking member.

In one embodiment, in said opened position, said cover is substantially horizontal.

In one embodiment, said hinge member allows said cover to translate along a first axis away and towards said frame support in addition to allowing said cover to pivot, with said cover being allowed to pivot only when it is first translated away from said frame support along said first axis.

In one embodiment, said hinge member allows said cover to further translate along a second axis that is transversal to said first axis, with said cover being pivoted into said opened position after having been translated away from said frame support along said first axis and then along said second axis.

In one embodiment, said plaque support member is carried by said frame support.

In one embodiment, said frame support comprises anchors for attachment to the shutter and a backing panel attached to said anchors, with said plaque support member being carried by said backing panel.

In one embodiment, the commemorative plaque further comprises a lock for releasably locking said cover in said closed position.

In one embodiment, said lock comprises fasteners linking said cover to said frame support.

DETAILED DESCRIPTION OF THE EMBODIMENTS

FIGS. 1-8 show a commemorative plaque frame 20 for supporting and displaying a commemorative plaque 22 on a funerary crypt or niche shutter 24, according to the present invention. It is understood, however, that the commemorative plaque frame 20 could be installed on any wall surface, and expressions such as "shutter" and "funerary crypt or niche shutter" are considered to encompass herein any suitable walls, panels or doors. Shutter 24 is shown to be vertical and although this is likely to be the case in most funerary installations, it could also be inclined or horizontal. Herein, shutter 24 will be considered to be the front panel of a funerary crypt or niche wherein a coffin or ashes of one or more deceased person(s) can be stored, although it might be a distinct wall behind which no funerary urn or coffin is stored. Shutter 24 may be made of stone or any other suitable material.

Commemorative plaque 22 is shown to be a flat rectangular slab of marble, but it could be made of any other suitable material and could be of another shape.

Figure 1:
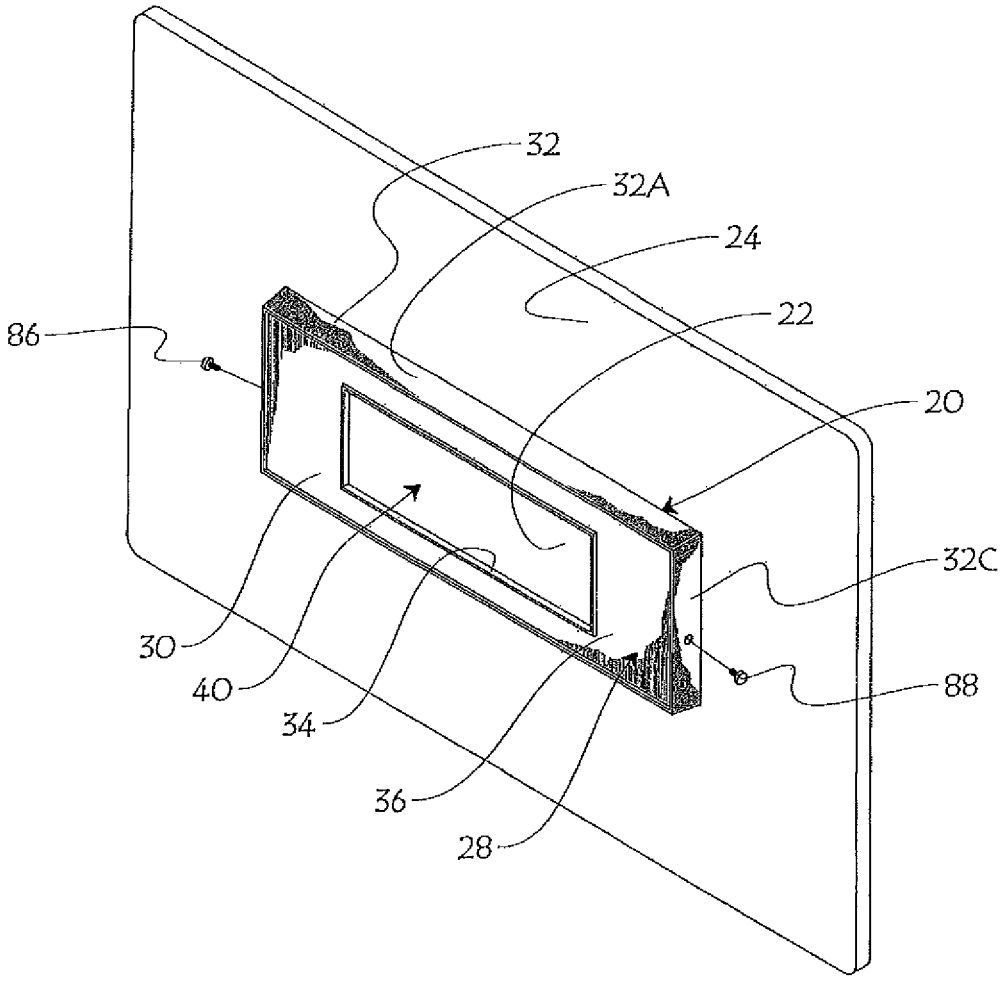
FIG. 1 is a perspective view showing a commemorative plaque frame according to the present invention attached to a crypt or niche shutter, with the cover of the commemorative plaque frame being in its closed position and enclosing a commemorative plaque, and with the locking screws being shown removed from the commemorative plaque frame.
Figure 2:
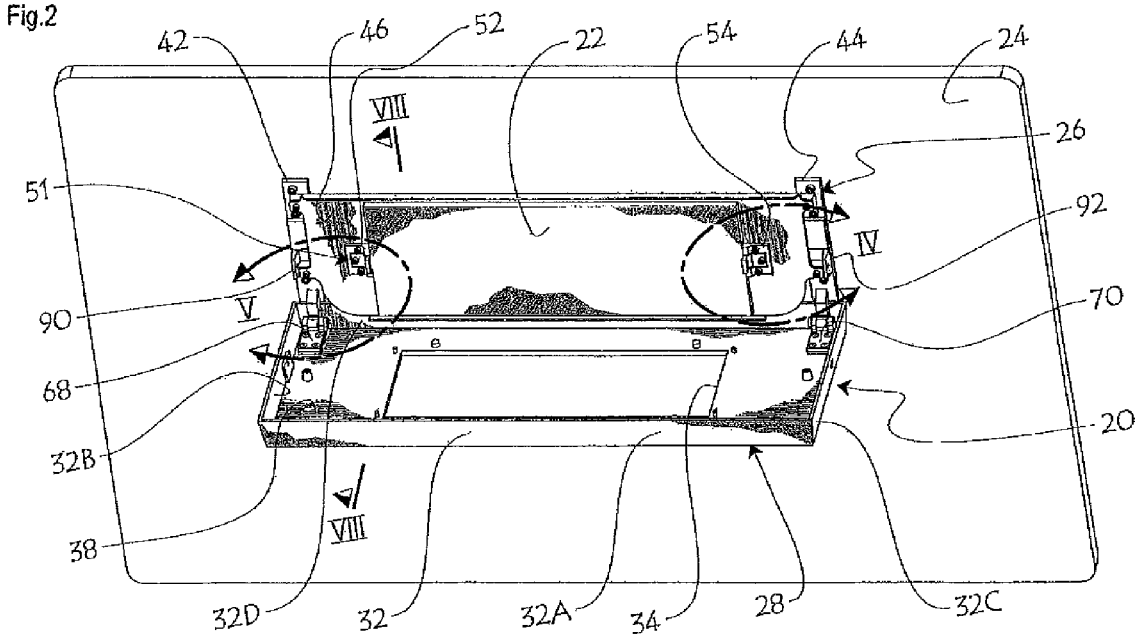
FIG. 2 is similar to FIG. 1, although at a slightly enlarged scale and slightly different perspective angle, and with the cover of the commemorative plaque being in its opened position.
Figure 3:
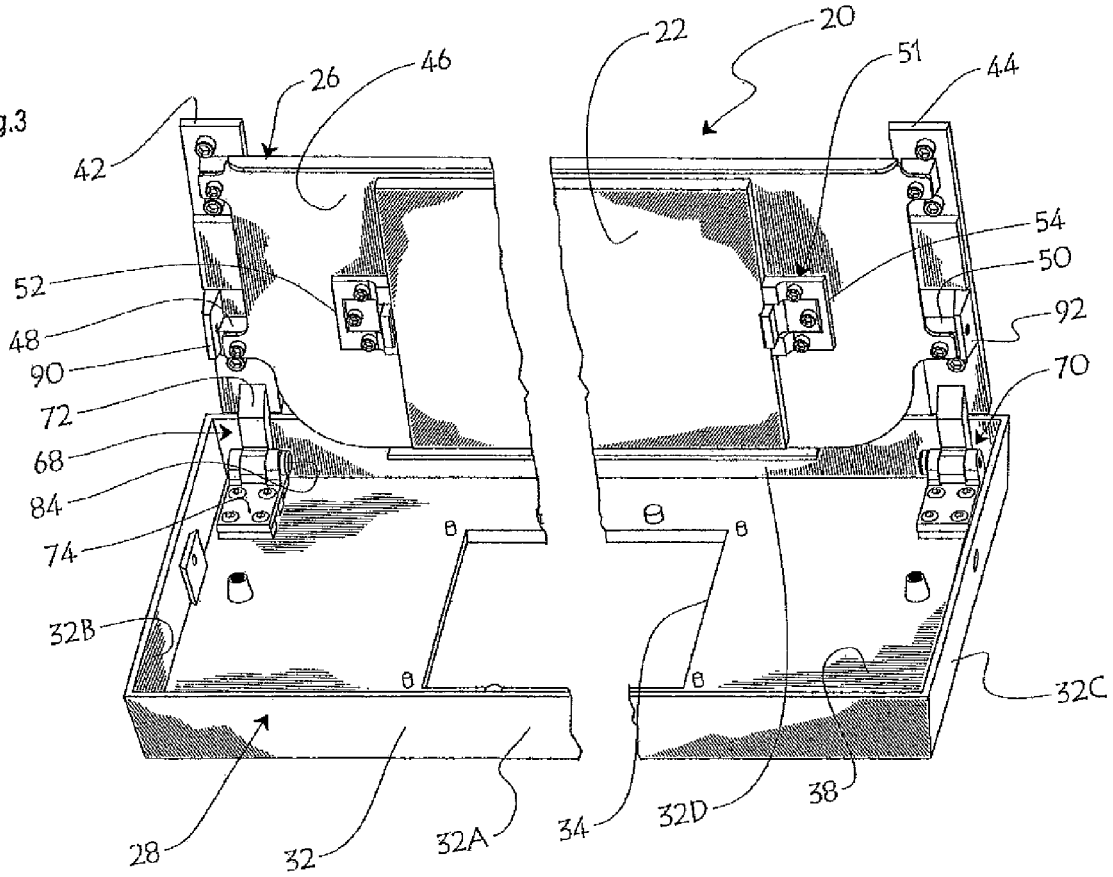
FIG. 3 is an enlarged fragmented perspective view of the commemorative plaque frame and commemorative plaque of FIG. 2.
Figure 4:
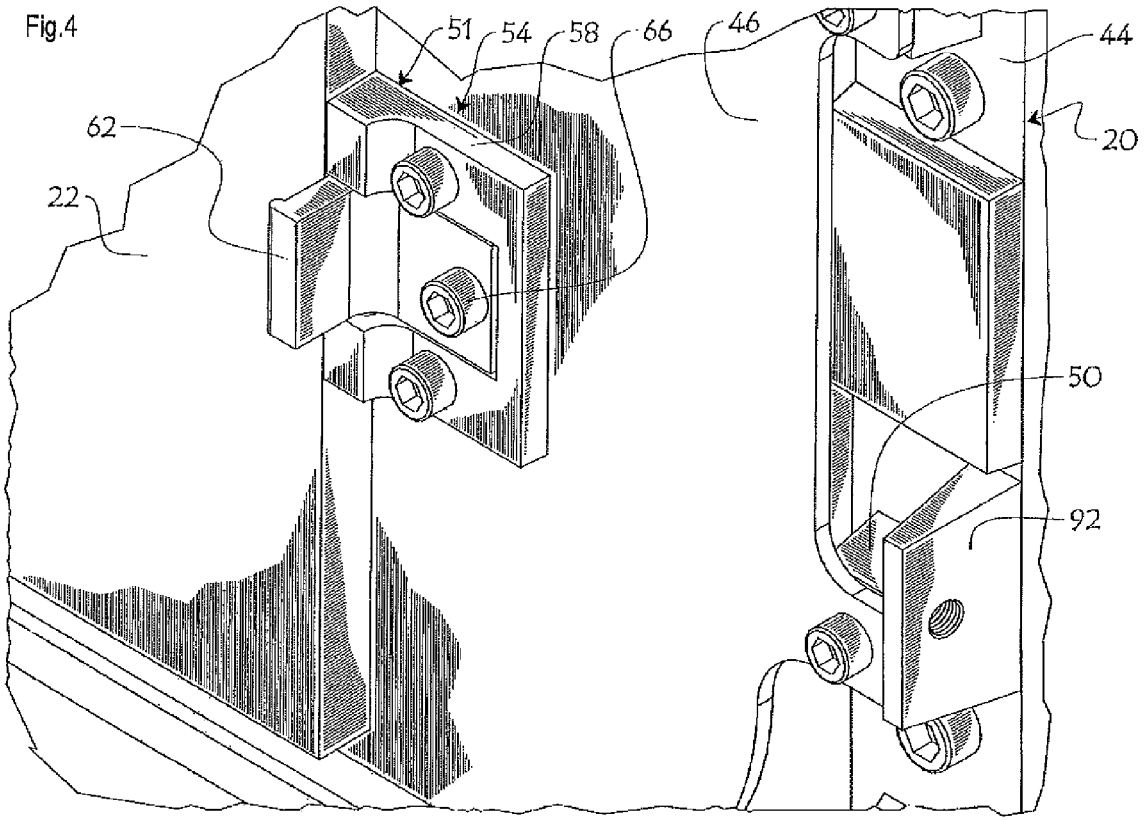
FIGS. 4 and 5 are partial enlarged perspective views of the areas respectively circumscribed by lines IV and V in FIG. 2, with part of the yoke being broken in FIG. 5 to show the L-shaped opening of the hinge member leg and the hinge pin therein.
Figure 5:
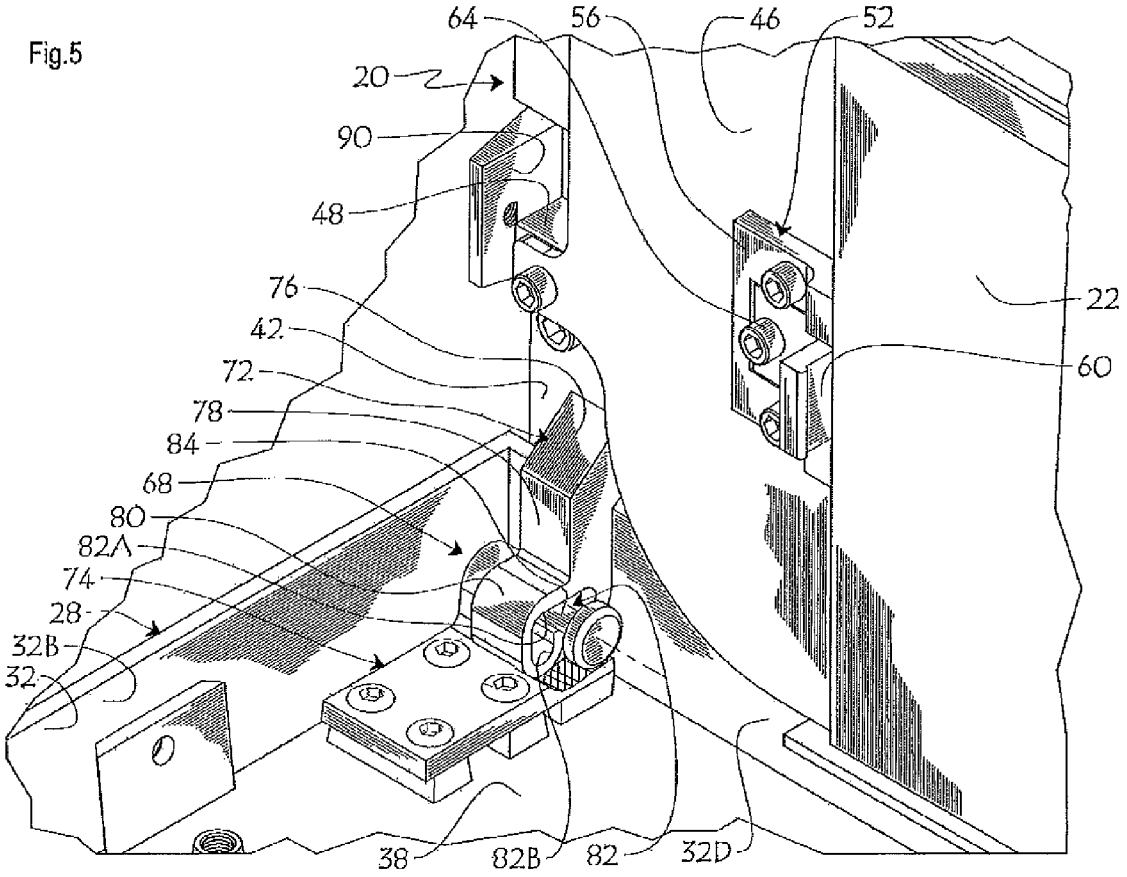
Figure 6:
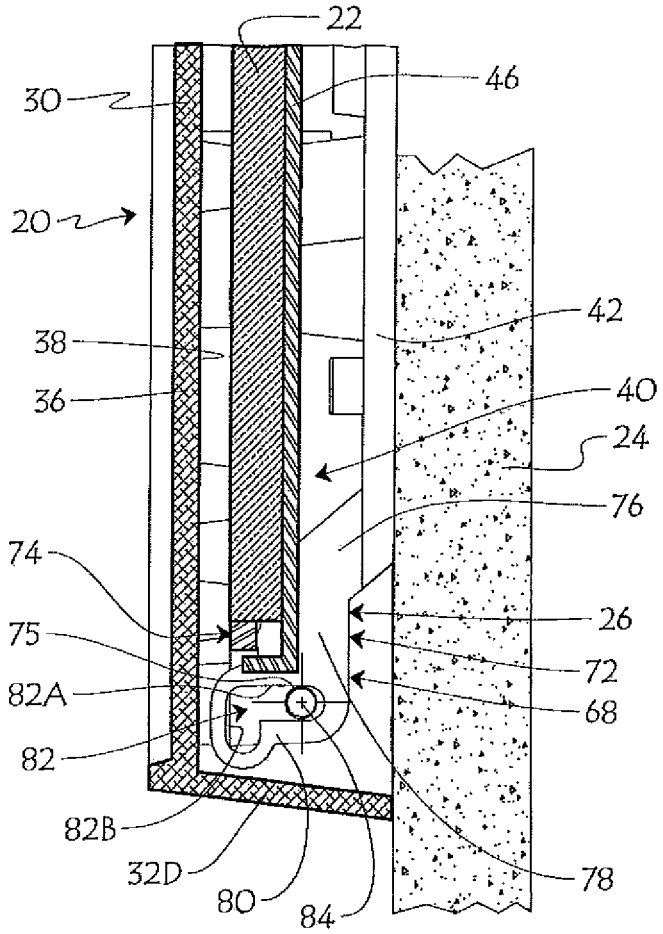
FIGS. 6-8 are partly broken partial cross-sectional views showing the bottom portion of the commemorative plaque frame and of the commemorative plaque, and an adjacent section of the crypt or niche shutter, and sequentially showing the cover in its closed position against the shutter in FIG. 6, translated away from the shutter and downwardly in FIG. 7, and pivoted into its opened position in FIG. 8; with line VIII-VIII in FIG. 2 showing where the cross-section is taken when the cover is in its opened position such as in FIG. 8.
Figure 7:
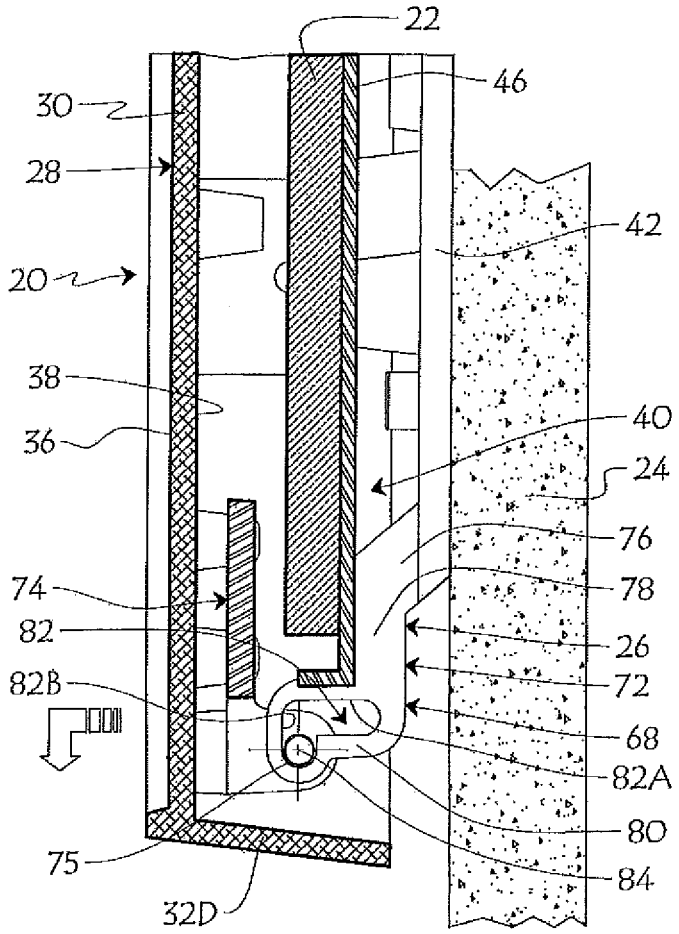

Commemorative plaque frame 20 comprises a frame support 26 attached to shutter 24 and a cover 28 pivotally attached to frame support 26 so as to be pivotable between an opened position in which cover 28 is pivoted away from shutter 24 as shown in FIGS. 2-5 and 8; and a closed position in which cover 28 is pivoted towards or against shutter 24 as shown in FIGS. 1, 6 and 7. Cover 28 is attached to frame support 26 in non-removable fashion in that it is not intended to be entirely removed from frame support 26 during normal use, i.e. it remains pivotally attached thereto. Of course, outside of the normal use of commemorative plaque frame 20, for example to remove it entirely from shutter 24, suitable tools could enable the dismantlement of commemorative plaque frame 20.

Cover 28 is generally rectangular and defines a front wall 30 and a top wall 32*a*, a bottom wall 32*b*, and two side walls 32*c*, 32*d*. Top wall 32*a*, bottom wall 32*b*, and side walls 32*c*, 32*d* are collectively referred to herein as peripheral wall 32.

A window 34 is provided in cover front wall 30. Window 34 may be a simple opening as shown in the annexed drawings, or may further include a transparent panel (not shown) made of glass or plastic.

Cover 28 defines opposite outer and inner sides 36, 38, with inner side 38 facing shutter 24 when cover 28 is in its closed position and outer side 36 facing away from shutter 24 when cover 28 is in its closed position.

A plaque enclosure 40 is defined on inner side 38 of cover 28 when cover 28 is in its closed position. Plaque enclosure 40 is sized for housing commemorative plaque 22 therein such that commemorative plaque 22 is at least partly visible through window 34. Engravings or other information provided on commemorative plaque 22 can consequently be seen even when cover 28 is in its closed position. Peripheral wall 32 surrounds commemorative plaque 22 spacedly therefrom when cover 28 is in its closed position.

Frame support 26 comprises a pair of anchors 42, 44, in the form of attachment plates, that are screwed into shutter 24; and a backing panel 46 attached to anchors 42, 44 by means of panel attachment brackets 48, 50.

Commemorative plaque frame 20 also comprises a plaque support member 51 carried by frame support 26 that supports commemorative plaque 22 in plaque enclosure 40. More particularly, the plaque support member comprises a pair of plaque attachment brackets 52, 54 attached to backing panel 46 and that hold commemorative plaque 22 therebetween. As shown in FIGS. 4 and 5, plaque attachment brackets 52, 54 each comprise a base 56, 58 fixed to backing panel 46, in which an L-shaped press-member 60, 62 is slidable. The position of press-members 60, 62 is adjustable with cam screws 64, 66 to allow commemorative plaque 22 to be tightly squeezed and held between press members 60, 62.

Cover 28 is pivotally attached to frame support 26, and more particularly to anchors 42, 44, through the instrumentality of a pair of hinge members 68, 70. Each hinge member 68, 70, for example hinge member 68 as shown in FIGS. 3 and 5-8, comprises a leg 72 attached to its corresponding anchor 42 and a yoke 74 attached to cover 28, at a bottom thereof, i.e. on its lower half when it is positioned in its closed position; and more particularly near its bottom wall 32*d*. This attachment of yoke 74 to the bottom of cover 28 allows cover 28 to pivot downwardly when it is opened.

Leg 72 comprises a first segment 76 that extends away from anchor 42; a second segment 78 that extends downwardly from first segment 76 and spacedly from anchor 42; and a third segment 80 that extends away from second segment 78 in a direction opposite anchor 42. Third segment 80 comprises an L-shaped opening 82 therein with a first opening segment 82*a* aligned along a first axis transversal to shutter 24, and more particularly disposed horizontally; and a second opening segment 82*b* aligned along a second axis transversal to the first axis, and more particularly disposed vertically.

Yoke 74 comprises coaxial openings 75. A hinge pin 84 extends through the coaxial openings 75 of yoke 74 and snugly fits therein such that hinge pin 84 is allowed to rotate within yoke 74 but not to translate.

Hinge pin 84 further extends through L-shaped opening 82 of leg 72 such that it may not only rotate therein but also translate within L-shaped opening 82. Consequently, cover 28 may not only pivot towards and away from shutter 24, but it is also allowed to translate along the first above-mentioned axis away and towards frame support 26, and along the second above-mentioned axis that is transversal to the first axis.

In use, cover 28 can be pivoted into its closed position shown in FIGS. 1 and 6 to protect commemorative plaque 22 while still allowing visual access to one surface of commemorative plaque 22 through window 34, where information may be displayed. In this closed position, cover 28 can be locked with a lock in the form of a pair of fasteners 86, 88 (FIG. 1), such as locking screws, that are threaded through the side walls 32*b*, 32*c* of cover 28 and through locking walls 90, 92 provided on first and second anchors 42, 44. Access to commemorative plaque 22 is consequently limited by requiring the removal of fasteners 86, 88 to open cover 28. Other locking devices could alternately be envisioned instead of or in addition to fasteners 86, 88, including some that would require authorized access such as a lock-and-key.

In the closed position of cover 28, cover peripheral wall 32 abuts with its free peripheral edge against shutter 24. A seal (not shown) could be provided along the free peripheral edge of peripheral wall 32.

To pivot cover 28 into its opened position, fasteners 86, 88 are first removed to unlock cover 28 from frame support 26.

However, cover 28 is not yet allowed to pivot towards it opened position. This is desirable to avoid cover 28, which can be relatively heavy, from accidentally pivoting into its opened position under gravity and injuring a person standing in front of cover 28, immediately after fasteners 86, 88 are removed. Cover 28 indeed abuts with its peripheral wall 32, and most importantly with bottom wall 32*d*, against shutter 24 to prevent the pivotal displacement towards its opened position.

As shown in FIG. 7, to allow cover 28 to pivot into its opened position after locking screws 86, 88 are removed, cover 28 must first be translated away from shutter 24 along its first axis. This is accomplished by pulling on cover 28 which will result in hinge pins 84 sliding in the first opening segments 82*a* of yokes 74 along the first axis. Once hinge pins 84 reach the outermost position within first opening segments 82*a*, i.e. away from shutter 24 and frame support 26, the weight of cover 28 will carry it naturally under gravity downwards along the second axis with hinge pins 84 then sliding into the second opening segments 82*b* until hinge pins 84 come to rest at the bottom of second opening segments 82*b*.

Figure 8:
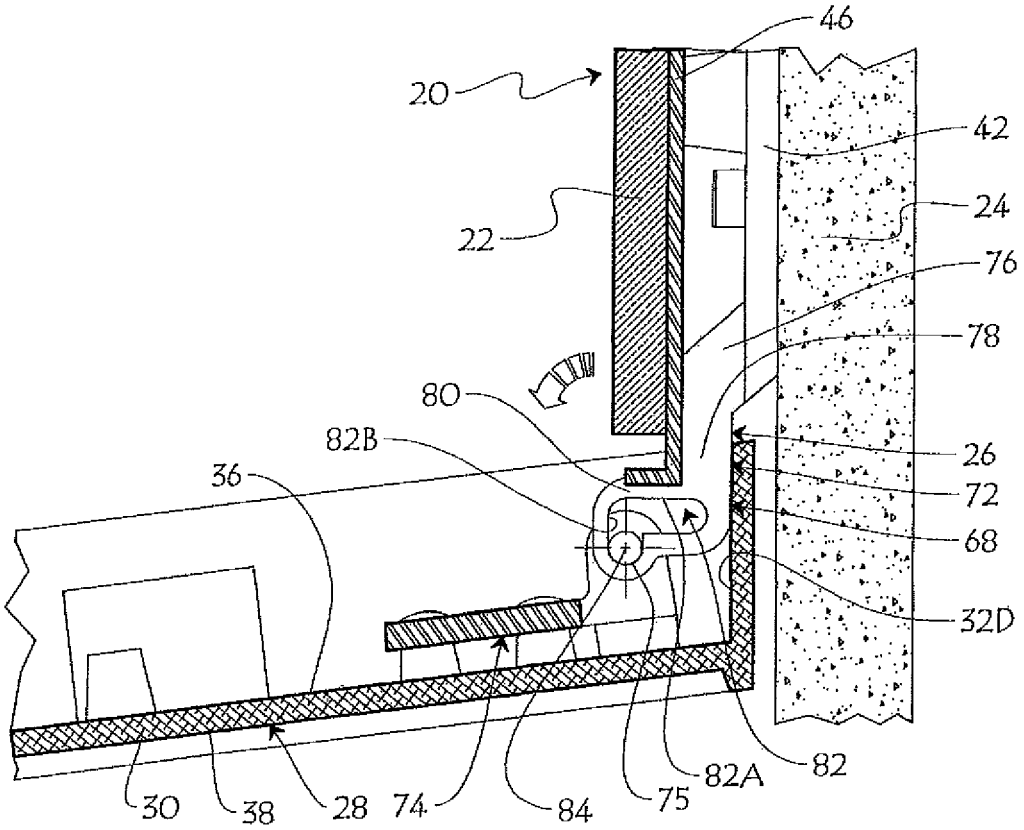

In this translated position, cover 28 will be allowed to pivot into its opened position. Indeed, the bottom wall 32*d* of cover 28 will have enough leeway to pivot towards shutter 24, and more particularly between shutter 24 and the second segments 78 of legs 72 of hinge members 68, 70, as shown in FIG. 8. In fact, cover 28 may commence to pivot towards its opened position as soon as it is first translated along the first axis. But its full deployment will only be allowed when hinge pins come to rest into the bottom of second opening segments 82*b*.

When cover 28 reaches its opened position, bottom wall 32*d* of cover 28 will abut against the rear surface of the second segments 78 of legs 72 of hinge member 68, 70 thereby allowing cover 28 to remain in an opened position that does not freely hang from frame support 26 but is close to horizontal instead. Second segments 78 of legs 72 of hinge members 68, 70 consequently represent blocking members in the form of stops capable of maintaining the cover in the opened position by the abutment of bottom walls 32*d* thereagainst.

One advantage of the commemorative plaque frame of the present invention is that it does not require removal of the cover to access or handle the commemorative plaque, since the cover is installed to the frame support in non-removable fashion and may be simply pivoted to open or close, to allow access or prevent access to the plaque enclosure.

Another advantage of the present invention is that the cover pivots downwardly, thereby not requiring a mechanism to maintain it in its opened position such as a hook that requires manipulation to enable. By providing a simple stop to prevent the cover from freely hanging from the hinge members, accidental collision of the cover with the crypt or niche shutter is however prevented.

Another advantage of the present invention is that the hinge members, by requiring translation of the hinge pin to enable pivotal displacement of the cover, help prevent opening of the cover at an undesirable time, for example while the locking screws are being removed and a person is standing in front of the commemorative plaque frame.

In an alternate embodiment, the plaque support member could be carried by the cover instead of by the frame support. Opening and closing the cover would be a bit more cumbersome since it would then be loaded with the weight of the commemorative plaque, but access to the commemorative plaque would still be easy and would not require removal of the cover. The other advantages noted above would remain true also for this alternate embodiment.

The invention claimed is:

1. A commemorative plaque frame for supporting and displaying a commemorative plaque on a funerary crypt or niche shutter, comprising:

a frame support for attachment to the shutter;

a cover comprising a window, said cover being pivotally attached to said frame support in non-removable fashion with a hinge member so as to be pivotable between an opened position in which said cover is pivoted away from the shutter; and a closed position in which said cover is pivoted against the shutter; said cover defining a front wall having opposite outer and inner sides and a peripheral wall extending away from said inner side of said front wall, with said inner side of said front wall facing the shutter when said cover is in said closed position and said outer side of said front wall facing away from the shutter when said cover is in said closed position and said peripheral wall engaging said shutter when said cover is in said closed position; wherein said hinge member allows said cover to translate along a first axis away and towards said frame support in addition to allowing said cover to pivot, with said cover being allowed to pivot towards said open position only when said cover is first translated away from said frame support along said first axis for preventing said peripheral wall from engaging said shutter, wherein said hinge member allows said cover to further translate along a second axis that is transversal to said first axis, with said cover being pivoted into said opened position after having been translated away from said frame support along said first axis away from said frame support, and said cover being translated along said second axis away from said first axis to avoid said cover from being accidentally translated towards said frame support along said first axis for preventing said peripheral wall from accidentally engaging said shutter while said cover is being pivoted into said opened position;

a plaque enclosure defined on said inner side of said front wall of said cover when said cover is in said closed position, said plaque enclosure sized for housing the commemorative plaque therein such that the commemorative plaque is enclosed between said front wall and said peripheral wall and said shutter and such that the commemorative plaque is at least partly visible through said window; and a plaque support member carried by one of said cover and said frame support, for supporting the commemorative plaque in said plaque enclosure.

2. A commemorative plaque as defined in claim 1, further comprising a blocking member capable of maintaining said cover in said opened position.

3. A commemorative plaque frame as defined in claim 2, wherein said blocking member comprises a stop provided on said frame support on which said cover abuts.

4. A commemorative plaque frame as defined in claim 3, wherein said stop includes a first segment and a second segment, said first segment extending away from said frame support to space the second segment from said frame support.

5. A commemorative plaque frame as defined in claim 4, wherein in said opened position a portion of said peripheral wall of said cover contacts the second segment of said stop.

6. A commemorative plaque frame as defined in claim 2, wherein when said cover is in said closed position, it defines a top and a bottom, said cover being pivotally attached to said plaque support member with said hinge member that is attached to said plaque support member and to said bottom of said cover.

7. A commemorative plaque frame as defined in claim 6, wherein in said closed position, said cover is vertical and in said opened position, said cover is maintained in a transversal position with respect to the vertical opened position by means of said blocking member.

8. A commemorative plaque frame as defined in claim 7, wherein in said opened position, said cover is substantially horizontal.

9. A commemorative plaque frame as defined in claim 1, wherein said plaque support member is carried by said frame support.

10. A commemorative plaque frame as defined in claim 9, wherein said frame support comprises anchors for attachment to the shutter and a backing panel attached to said anchors, with said plaque support member being carried by said backing panel.

11. A commemorative plaque as defined in claim 1, further comprising a lock for releasably locking said cover in said closed position.

12. A commemorative plaque frame as defined in claim 11, wherein said lock comprises fasteners linking said cover to said frame support.

13. A commemorative plaque frame as defined in claim 1, wherein said frame support is enclosed between said front wall and said peripheral wall and said shutter when said cover is in said closed position.

14. A commemorative plaque frame as defined in claim 1, wherein said hinge member includes a yoke non-pivotally coupled to said cover and a leg non-pivotally coupled to said frame support, wherein a hinge pin is received in each of an opening formed in said yoke and an opening formed in said leg to pivotally couple said yoke to said leg.

* * * * *